United States Patent [19]

Dietrich

[11] 4,438,711

[45] Mar. 27, 1984

[54] FUR SEWING MACHINE

[75] Inventor: Herbert Dietrich, Kaislerslautern, Fed. Rep. of Germany

[73] Assignee: Pfaff Industriemaschinen GmbH, Fed. Rep. of Germany

[21] Appl. No.: 435,497

[22] Filed: Oct. 20, 1982

[30] Foreign Application Priority Data

Oct. 30, 1981 [DE] Fed. Rep. of Germany ..... 3143051

[51] Int. Cl.[3] ..... D05B 15/00; D05B 27/10

[52] U.S. Cl. ..... 112/16; 112/129

[58] Field of Search ..... 112/16, 18, 122, 129

[56] References Cited

U.S. PATENT DOCUMENTS

| | | | |
|---|---|---|---|
| 1,150,614 | 8/1915 | Moffatt | 112/16 |
| 1,201,084 | 10/1916 | Onderdonk | 112/16 |
| 1,271,059 | 7/1918 | Moffatt | 112/122 X |
| 1,952,387 | 3/1934 | Ross et al. | 112/16 |
| 2,104,807 | 1/1938 | Mladinich | 112/16 |
| 2,603,173 | 7/1952 | Olleo, Sr. | 112/16 |
| 3,238,903 | 3/1966 | Pav | 112/16 |

FOREIGN PATENT DOCUMENTS

| | | | |
|---|---|---|---|
| 951606 | 10/1956 | Fed. Rep. of Germany | 112/16 |
| 1055633 | 10/1953 | France | 112/16 |

*Primary Examiner*—H. Hampton Hunter

*Attorney, Agent, or Firm*—McGlew and Tuttle

[57] ABSTRACT

A fur sewing machine equipped with two feed discs is provided with a trimming mechanism. The trimming mechanism includes a trimming blade which is mounted for oscillatory motion close above the feed discs, and a fixed counterblade. The counterblade is secured to a blade holder which, at the same time, is used for axially fixing the feed disc which is supported on a displaceable carrier bracket. An exhaust device equipped with an injector nozzle is provided to remove the off cuts.

11 Claims, 4 Drawing Figures

FUR SEWING MACHINE

FIELD AND BACKGROUND OF THE INVENTION

The present invention relates in general to sewing machines and in particular to a new useful fur sewing machine including a fur edge cutter for cutting the edges of let-out fur pieces.

A prior art fur sewing machine which is relevant to the present invention is disclosed in German patent No. 951,606.

Let-out furskin parts have triangular end portions with a straight edge in the lengthwise direction, and a plurality of narrow furskin strips which are unilaterally offset relative to each other in the transverse direction and sewn together by individual seams, so that a zig-zag edge is produced.

Prior to sewing let-out furskins together into a large-surface piece of fur, their longitudinal sides must be trimmed to straight edges. Up to the present time, this used to be done manually by cutting the protruding triangular portions with scissors. Since this must be done very accurately and, in addition, without at the same time cutting away hair alongside the cutting line, the operation requires close attention and great skill. Since even a furskin of medium length already comprises about 100 individual cut locations, a correspondingly great deal of time is wasted for this purpose in the manufacture of a fur coat made up of a plurality of furskin parts. After being trimmed, the furskin parts are placed with the hair upon one another, the longitudinal edges to be connected to each other are aligned and then sewn together. The alignment of furskin parts again requires great accuracy and attention, as the earlier edge cutting. Further, prior to the sewing, care must be taken to keep the hair alongside the sewing line away from the stitching zone, since otherwise at least a portion of the hair would become sewn fast. For aligning the furskin parts and spreading the full hair, a suitable device has been provided as disclosed in the above mentioned German patent No. 951,606. However, experience has shown that after an initial training period, deft workers attain better results without such attachments, due to their dexterity alone.

SUMMARY OF THE INVENTION

The present invention is directed to a fur sewing machine which reduces the time consuming alignment of the furskin parts and smoothing of the fur hair before the trimming and sewing operation.

An object of the present invention is to provide a fur sewing machine having a housing and a stitch forming area which comprises two feed discs, one of which being mounted on a carrier bracket which is displaceable relative to the housing and a trimming mechanism disposed upstream of the stitch forming area and close above said feed discs, said mechanism comprising a trimming blade mounted for oscillation parallel to a plane of rotation of said feed discs and a stationary counter blade mounted for engagement with said trimming blade. According to the invention, the operations of trimming and sewing are performed in close succession. Consequently, furskin parts need to be adjusted and hair to be pushed away from the cutting and sewing line only once, namely prior to introducing the furskin parts between the blades of the trimming mechanism. After putting off the protruding furskin portions, the lengthwise edges are already aligned with each other and do not require any new alignment.

According to another feature of the invention, the counterblade is received in a blade holder which is supported on a carrier bracket. As the carrier bracket with the feed disk mounted thereon is moved from its operating position into a position for insertion remote from the other feed disc, to introduce two furskin parts, the counterblade is moved away from the trimming blade at the same time. Since the spacing of the two blades is thereby enlarged, the introduction of the furskin parts therebetween is facilitated.

A particularly simple and space saving provision is that the blade holder is at the same time used as a member for axially retaining the feed disc.

According to a still further feature of the invention the trimming blade remains resiliently applied against the counterblade and, consequently, during the return motion of the counterblade from its position for insertion to the cutting position, the two blades cannot collide with each other.

Another object of the present invention is thus to provide a fur sewing machine wherein the trimming blade includes a blade portion which extends parallel to the plane of rotation of the feed discs and includes a V-shape notch so that a cutting finger is formed, the blade portion being in surface contact with the counterblade, the trimming blade being secured to a swivel arm which is supported by a pivot rotatable about a vertical axis, and hinged for movement about a horizontal axis, and biasing means for urging said swivel arm about the horizontal axis toward said counterblade.

Due to these features, the trimming blade oscillates in synchronism with the stitch forming tools of the fur sewing machine and the possibility is given of timing the operation so that the cutting occurs during the interval between two feed steps of the intermittently driven feed discs.

A further object of the invention is to provide a fur sewing machine wherein the counterblade is associated with a plate for guiding fur parts which plate is provided in the zone of the other of the feed discs and is substantially arcuate in shape.

The guide plate assists in holding the furskin parts in contact with the counterblade and thus facilitates their guidance.

Another object of the invention is to provide a fur sewing machine which includes an exhaust device for removing cuttoff parts of the fur pieces from the cutting and stitch forming area.

With the aid of the exhaust device, the offcuts can be removed by suction to provide for an unhindered monitoring of the furskin parts and to prevent the refuse of cutting from being caught by the sewing thread and sewed on.

A further object of the invention is to provide a fur sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, the invention is explained in more detail while considering the drawings in which.

DESCRIPTION OF THE PREFERRED EMBODIMENT

Figure 1:
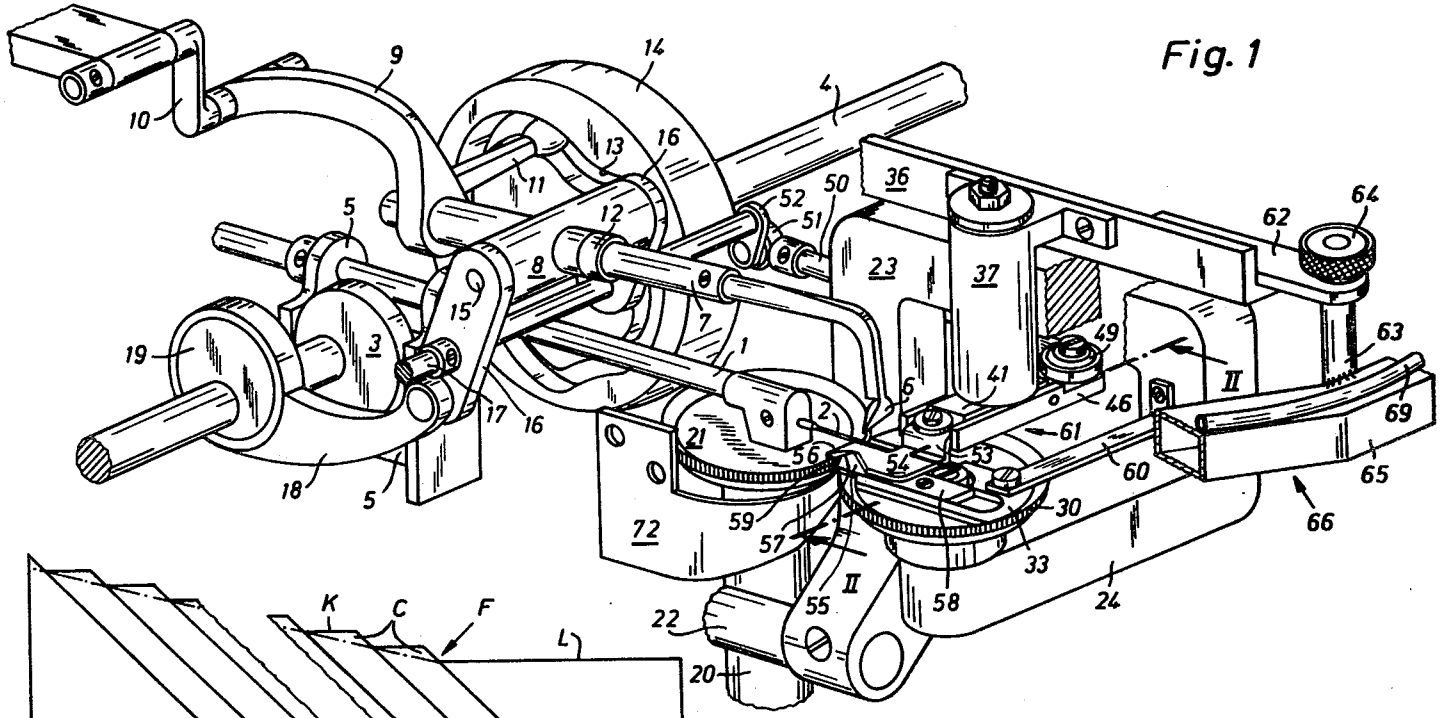
FIG. 1 is a perspective view of a fur sewing machine equipped with a trimming mechanism.
Figure 2:
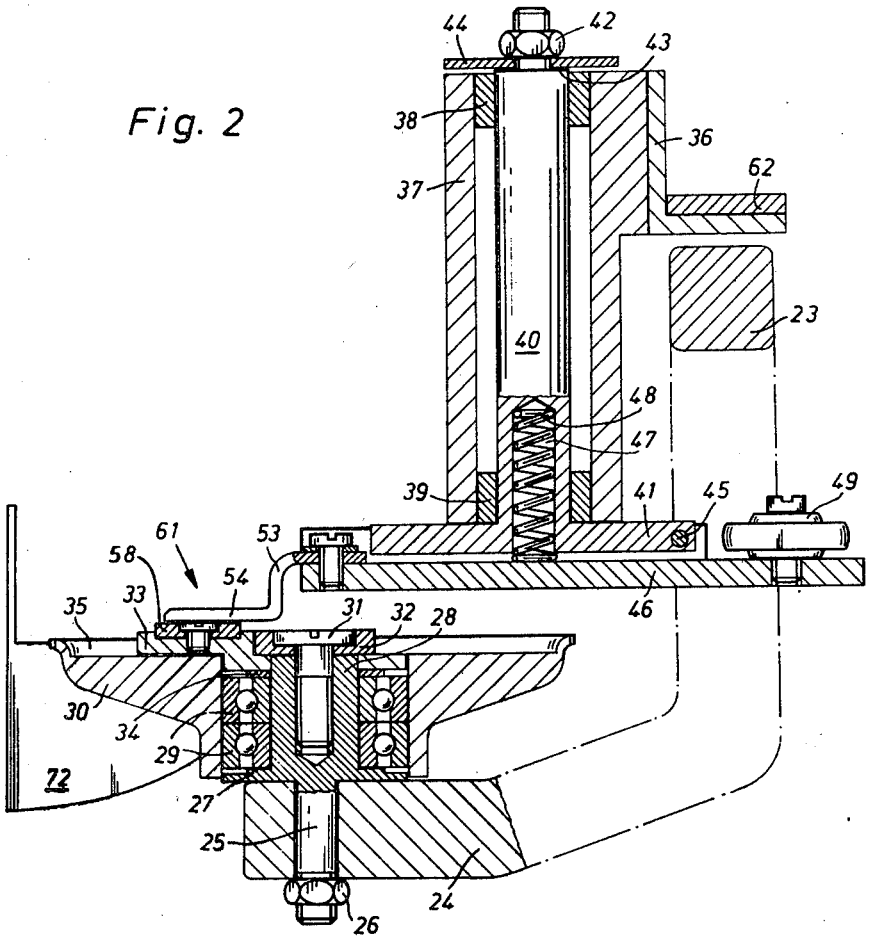
FIG. 2 is a sectional view taken along the line II—II of FIG. 1, of the feed disc supported on a carrier bracket.

Referring to the drawings, as shown in FIGS. 1 and 2, the inventive fur sewing machine comprises a needle bar 1 which is mounted in a housing (not shown) for reciprocating motion in the horizontal direction, and carries a thread guiding needle 2. Needle bar 1 is driven by an eccentric 3 secured to a shaft 4 which, during operation of the machine, rotates continually. Eccentric 3 is straddled by a fork 5 which is firmly clamped to needle bar 1, so that the horizontal components of motion of the eccentric are transmitted to needle bar 1.

Needle 2 cooperates with an oscillating hook 6 to form single-thread overcast stitches. Hook 6 is secured to an oscillating bar 7 which is mounted for rotation in a supporting cross member 8. Oscillating bar 7 carries an arm 9 in which it is rotatable and which is hinged to a crank 10 oscillating about a fixed axis. Another crank 11 is secured to the end of oscillating bar 7. The axial position of oscillating bar 7 relative to supporting member 8 is fixed by crank 11 and a shoulder 12 provided on the bar. The free end of crank 11 engages a cam groove 13 provided in a cam disc 14 which is secured to shaft 4. By means of two hinge pins 15, supporting member 8 is mounted for pivoting motion on the upper ends of two cranks 16 which are secured to a shaft 17. The lower end of left-hand crank 16 (as viewed in Fig. 1) is hinged to an eccentric arm 18 embracing an eccentric 19 which is secured to shaft 4.

A first feed disc 21 is carried on a vertical shaft 20 mounted in the housing. Shaft 20 is connected to a ratchet indexing mechanism (not shown) by which feed disc 21 is intermittently driven in conjunction with the motion of needle bar 1. A substantially U-shaped.carrier bracket 23 having a horizontally projecting arm 24 is secured to a supporting rod 22 which is not-rotatably mounted in the housing for axial, i.e. horizontal displacement. A screw bolt 25 is screwed into the end portion of arm 24 and secured in position by a nut 26. Bolt 25 has a shoulder portion 27 and a bearing portion 28. Bearing portion 28 carries two ball bearings 29 which support a second feed disc 30. A screw 31 engaging a taphole in bearing portion 28 of the bolt clamps ball bearings 29 downwardly against shoulder portion 27, through a needle plate 32, a blade holder 33, and a washer 34. Blade holder 33 is received in a shallow recess 35 of feed disc 30.

An angle bar 36 secured to the housing extends above carrier bracket 23. Bar 36 supports a holding fixture 37 for a pivot 40 which is mounted therein for rotation in two bushings 38, 39, and is provided at its lower end with a flange 41. Pivot 40 is secured axially in its position by flange 41 and, on its other end, by means of a nut 42 and a bearing plate 44 applied against a shoulder 43 of the pivot. By means of a horizontal pin 45, a swivel arm 46 having a U-shape cross section is hinged to flange 41. In a blind bore 47 of pivot 40, a compression spring 48 is accommodated urging swivel arm 46 downwardly.

One end of swivel arm 46 is connected through a spherical joint 49 to a connecting rod 50 which in turn is connected through a spherical joint 51 to a crank 52 which is secured to shaft 17. The other end of swivel arm 46 carries a trimming blade 53 comprising a substantially horizontally extending blade portion 54 and a cutting finger 56 which is formed at one side of a V-shape notch 55. Cutting finger 56 has its cutting edge 57 on the inner longitudinal side. Trimming blade 53 is associated with a counterblade 58 which is secured to a blade holder 33. The underside of counterblade 58 extends close to the upper edge of feed disc 30 and the end of the counterblade formed as a cutting edge 59 projects beyond feed disc 30. Secured to blade holder 33 is one end of an angle strip 60 whose other end is secured to carrier bracket 23. Trimming blade 53, counterblade 58, blade holder 33, and the component parts 36 to 52 form together a trimming mechanism 61.

Figure 3:
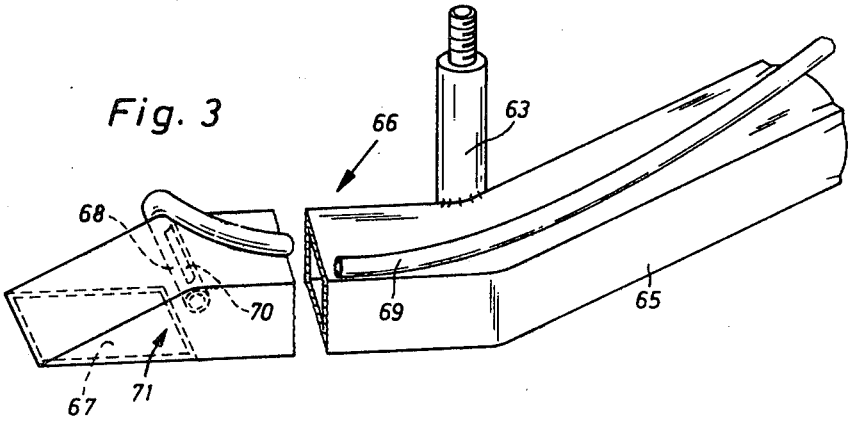
FIG. 3 is a perspective view of an exhaust device.

A duct 65 of an exhaust device 66 is secured by means of a screw bolt 63 and a nut 64 to a supporting strip 62 which is carried by angle bar 36. One end portion of duct 65 is positioned above, but spaced from, blade portion 54, close to cutting finger 56, and has an aperture 67 in its underside. The other end of duct 65 is connected through a flexible tube to a refuse tank (not shown). Near aperture 67, the end piece 68 of a compressed-air line 69 is introduced into duct 65. End piece 68 has an aperture 70 through which compressed air can flow into duct 65 so that air is taken in through aperture 67 to flow through the duct in the direction of refuse removal. The duct end provided with aperture 67 and the end piece 68 with aperture 70 form an injector nozzle 71 (See FIG. 3).

Spaced from feed disc 21, an arcuate guide plate 72 is secured to the housing. The upper edge of guide plate 72 extends below the plane of the underside of counterblade 58 up to close to the location where the two feed discs 21, 30 come together.

Figure 4:
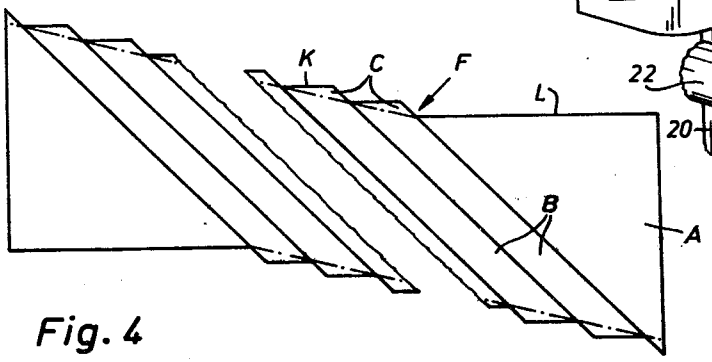
FIG. 4 shows a let-out furskin part.

The fur sewing machine operates as follows:

To introduce two furskin parts F (FIG. 4) to be sewn together between feed discs 21, 30, carrier bracket 23 supporting feed disc 30 is displaced from its operating position shown in FIG. 1 to the right. This increases the spacing not only between feed disc 30 and feed disc 21 but also between cutting edge 59 of counterblade 58 and cutting edge 57 of cutting finger 56. The two furskin parts F are now introduced below cutting edges 57, 59 through the gap between the two feed discs 21, 30, with their triangular end portions A having a straight longitudinal edge, ahead. The two mutually aligned longitudinal edges L are introduced at the level of the cutting plane of the two blades 53, 58. While positioning furskin parts F, the hair thereof is at the same time smoothed downwardly, either manually by the operator or by means of a mechanical device, substantially at right angles to longitudinal edges L , to keep it away from the cutting plane of blades 53,58 and from the following stitch forming area. Then, carrier bracket 23 is returned into its operating position and the fur sewing machine is set in operation.

By a conjoint operation of needle 2 and oscillating hook 6, longitudinal edges L of furskin parts F are connected to each other by single-thread overcast stitches. Through shaft 17, by which oscillating bar 7 is moved axially, connecting rod 50 and swivel arm 46 are moved concurrently with the stitch forming tools, i.e. with needle 2 and hook 6. The various movements are so timed that trimming blade 53 executes a cutting motion relative to counterblade 58 at the instant at which needle 2 is stuck in furskin parts F. Since drive feed disc 21 executes an advance step only within periods in which needle 2 is retracted, so that no feed takes place while needle 2 is stuck in furksin parts F, the oscillatory motion of trimming blade 53 cannot obstruct the advance of furksin parts F.

Simultaneously with the setting of fur sewing machine in operation, the exhaust device 66 is started, i.e. compressed air is supplied through line 69 and aperture 70 into duct 65, whereby underpressure is produced at aperture 67 of the duct. As long as end portions A move past the cutting area of trimming mechanism 61, trimming blade 53 slides over the longitudinal edges L of these portions, and no cutting takes place. However, as the zig zag edges K of furskin parts F, formed by the mutually offset furskin strips B, reach the cutting area of trimming mechanism 61, the triangular portions C are cut away one after the other. The individual cut-off portions C are immediately taken off by suction and are conveyed to the refuse tank (not shown), so that the cutting area and the adjacent stitch forming area remain free from cuttings and loose hair.

Guide plate 72 facilitates the guidance and alignment of furskin parts F, since it serves as a contact face, and its upper edge is at the same time a reference level for aligning the furskin parts F in height.

Since the distance between the cutting area of the trimming mechanism 61 and the stitch forming area is very small and virtually no risk is run that furskin parts F on their way from the cutting area to the stitch forming area would deviate from their aligned positions, furskin parts need to be fitted to each other and aligned in height only once, namely upstream of trimming mechanism 61. Downstream of trimming mechanism 61, both the uncut longitudinal edges L of end portions A and the edges of the individual furskin strips B made straight by cutting off portions C, are in a position ready for sewing, and no new alignment is necessary.

Trimming blade 53, i.e., swivel arm 46, might also be driven by a separate motor, through an eccentric provided on the ouput shaft of the motor, and a connecting rod. In such a case, however, a very much higher cutting frequency must be provided, to prevent the furskin parts from obstructing the feed motion, because then the oscillatory motion of trimming blade 53 is not synchronized with the movements of oscillating bar 7 and, consequently, cutting motions might take place during the advance movement of furskin parts F.

While a specific embodiment of the invention has been shown and described in detail to illustrate the application of the principles of the invention, it will be understood that the invention may be embodied otherwise without departing from such principles.

What is claimed is:

1. A fur sewing machine having a housing and a stitch forming area, comprising: a carrier bracket which is displaceable relative to the housing; two feed discs, one of which being mounted on said carrier bracket, said feed discs being rotatably mounted in a plane; a rod non-rotatably and axially displaceably connected in the housing and connected to said carrier bracket for displacing said carrier bracket horizontally relative to the housing; and a trimming mechanism upstream of the stitch forming area and close above said feed discs, said trimming mechanism comprising a trimming blade mounted for oscillation parallel to the plane of rotation of said feed discs, and a relatively stationary counterblade mounted for engagement with said trimming blade and extending parallel to the plane of rotation of said feed discs.

2. A fur sewing machine according to claim 1, wherein said counterblade is received in a blade holder which is secured to said carrier bracket.

3. A fur sewing machine according to claim 2, wherein said bldde holder is structured for retaining one of said feed discs axially.

4. A fur sewing machine according to claim 1, wherein said trimming blade includes a blade portion which extends parallel to the plane of rotation of said feed discs and includes a V-shape notch so that a cutting finger is formed, said blade portion being in surface contact with said counterblade, said trimming blade being secured to a swivel arm which is supported by a pivot rotatable about a vertical axis and is hinged for movement about a horizontal axis, and biasing means urging said swivel arm about the horizontal axis toward said counterblade

5. A fur sewing machine according to claim 4, including an oscillating, bar carrying a loop-taking hook, which bar is driven by a shaft, said swivel arm being connected through a connecting rod to a crank which is secured to said shaft for driving said oscillating bar.

6. A fur sewing machine according to claim 1, wherein said counterblade is associated with a plate for guiding fur parts, which plate is provided in the zone of the other of said feed discs and is substantially arcuate in shape.

7. A fur sewing machine according to claim 1, including means to remove offcuts by suction, comprising an exhaust device having an injector nozzle located in a cutting area for said blades.

8. A fur sewing machine having a housing and a stitch forming area comprising:

a first shaft connected to the housing;

a first disc connected to said first shaft for rotation in a rotation plane;

a bracket mounted to said housing for vertical motion with resepct thereto;

a second disc rotatably mounted to said bracket in said rotation plane, said bracket movable to bring said first and second disc into close association with each other;

a trimming blade mounted to the housing for oscillation parallel to said rotation plane;

blade drive means connected to said trimming blade for oscillating said trimming blade; and a counterblade connected to said bracket, engaged with said trimming blade and extending parallel to said rotation plane.

9. A fur sewing machine according to claim 8, wherein said means for driving said trimming blade comprises a pivot connected to the housing, a swivel arm pivotally mounted to said pivot, biasing means for urging said swivel arm into a direction to bias said trimming blade against said counterblade and a connecting rod pivotally connected to said swivel bracket for moving said swivel bracket on said pivot.

10. A fur sewing machine according to claim 9, including exhaust means for removing pieces cut by said blades from the stitch forming area comprising a duct having an opening adjacent the stitch forming area and a compressed air line having an end with an opening thereof extending in said duct for directing compressed air in a direction in said duct away from said cut opening.

11. A fur sewing machine according to claim 8, wherein said bracket is substantially U-shaped, a second shaft mounted to said housing for axial non-rotating motion connected to one end of said bracket and said second disc rotatably mounted to an opposite end of said bracket, said rotation plane of said first and second discs being substantially horizontal.

* * * * *